US006314664B1

(12) United States Patent
Kita et al.

(10) Patent No.: US 6,314,664 B1
(45) Date of Patent: Nov. 13, 2001

(54) ATHLETIC SHOE MIDSOLE DESIGN AND CONSTRUCTION

(75) Inventors: Kenjiro Kita; Takaya Kimura; Yasunori Kaneko, all of Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/437,918

(22) Filed: Nov. 10, 1999

Related U.S. Application Data

(63) Continuation-in-part of application No. 08/910,794, filed on Aug. 13, 1997, now abandoned.

(30) Foreign Application Priority Data

Apr. 18, 1997 (JP) ..... 9-116376

(51) Int. Cl.[7] ..... A43B 13/12; A43B 13/18; A43B 13/14; A43B 21/26; A43B 21/32

(52) U.S. Cl. ..... 36/30 R; 36/28; 36/35 R; 36/31; 36/37

(58) Field of Search ..... 36/27, 28, 30 R, 36/35 R, 25 R, 31, 92, 87, 102, 30 A, 36 A, 37, 71, 44, 114, 88, 76 C, 103, 29, 312 R

(56) References Cited

U.S. PATENT DOCUMENTS

| | | | | |
|---|---|---|---|---|
| 1,050,807 | * | 1/1913 | Chamberlain | 36/29 |
| 2,364,134 | * | 12/1944 | Dow et al. | 36/25 R |
| 2,400,487 | * | 5/1946 | Clark | 36/25 R |
| 2,677,906 | * | 5/1954 | Reed | 36/28 |
| 4,356,642 | * | 11/1982 | Herman | 36/44 |
| 4,399,620 | * | 8/1983 | Funck | 36/30 R |
| 4,561,195 | * | 12/1985 | Onoda et al. | 36/30 R |
| 4,774,774 | | 10/1988 | Allen, Jr. . | |
| 4,798,010 | * | 1/1989 | Sugiyama | 36/30 R |
| 4,805,319 | * | 2/1989 | Tonkel | 36/30 R |
| 4,864,737 | * | 9/1989 | Marrello | 36/29 |
| 4,910,882 | * | 3/1990 | Goller | 36/44 |
| 4,999,931 | * | 3/1991 | Vermeulen | 36/29 |
| 5,185,943 | | 2/1993 | Tong et al. . | |
| 5,720,118 | | 2/1998 | Mayer et al. . | |
| 5,799,415 | * | 9/1998 | Kenji et al. | 36/44 |

FOREIGN PATENT DOCUMENTS

| | | | | |
|---|---|---|---|---|
| 19641866 | * | 12/1996 | (DE) | 36/29 |
| 0857434 | | 8/1998 | (EP) . | |
| 0878142 | | 11/1998 | (EP) . | |
| 2032760 | * | 5/1980 | (GB) | 36/30 R |
| 61-6804 | | 7/1984 | (JP) . | |
| 11-203 | | 1/1999 | (JP) . | |
| 90/06699 | * | 6/1990 | (WO) | 36/28 |

* cited by examiner

*Primary Examiner*—M. D. Patterson
*Assistant Examiner*—Anthony Stashick
(74) *Attorney, Agent, or Firm*—W. F. Fasse; W. G. Fasse

(57) ABSTRACT

A midsole assembly for an athletic shoe includes a midsole formed of soft elastic material, and a corrugated sheet disposed in at least a heel portion of the midsole. The amplitude of the wave configuration of the corrugated sheet is larger at the medial and lateral sides of the heel portion and smaller at the central portion between the medial and lateral sides. Alternatively, the wave phase of the corrugated sheet is offset by one half of a wave pitch between the medial and lateral sides.

13 Claims, 10 Drawing Sheets

ATHLETIC SHOE MIDSOLE DESIGN AND CONSTRUCTION

CROSS-REFERENCE TO RELATED APPLICATION

This application is a Continuation-In-Part of prior copending U.S. application Ser. No. 08/910,794 filed Aug. 13, 1997 now abandoned, the entire disclosure of which is incorporated herein by reference, and is related to U.S. applications Ser. No.: 09/314,366, filed May 19, 1999; Ser. No. 09/318,578, filed May 25, 1999; Ser. No. 09/339,269, filed on Jun. 23, 1999; and Ser. No. 09/395,516, filed on Sep. 14, 1999.

FIELD OF THE INVENTION

The present invention relates to an athletic shoe midsole design and construction. More particularly, the invention relates to a midsole assembly where there are provided a midsole formed of soft elastic material and a corrugated sheet disposed in the midsole.

BACKGROUND INFORMATION

The sole of an athletic shoe used in various sports is generally comprised of a midsole and an outsole fitted under the midsole, directly contacting with the ground. The midsole is typically formed of soft elastic material in order to ensure adequate cushioning properties.

Running stability as well as adequate cushioning properties are required in athletic shoes. There is a need to prevent shoes from being deformed excessively in the lateral or transverse direction when contacting with the ground.

As shown in Japanese Utility Model Examined Publication No. 61-6804, the applicant of the present invention proposes a midsole assembly having a corrugated sheet therein, which can prevent such an excessive lateral deformation of shoes.

The midsole assembly shown in the above publication incorporates a corrugated sheet in a heel portion of a midsole, which can produce resistant force preventing the heel portion of a midsole from being deformed laterally or transversely when a shoe contacts with the ground. Thus, the transverse deformation of the heel portion of a shoe is prevented.

However, it depends on the kind of athletics or athletes whether an athlete lands on the ground more frequently from the medial portion or the lateral portion of the heel at the onset of landing. For example, since tennis or basketball players move more often in the transverse direction and the medial portions of their heels tend to first contact the ground, the heels lean outwardly and so-called supination often occurs. On the other hand, since runners or joggers tend to land on the ground from the lateral portions of their heels and the load moves toward the toes, the heels lean inwardly and so-called pronation often occurs.

These pronation and supination movements are normal movements when an athlete's foot comes in contact with the ground. But over-pronation or over-supination may cause injuries to the ankle, knee and hip of an athlete.

In the conventional midsole design, there is provided a corrugated sheet having a constant wave configuration in both the transverse direction and the longitudinal direction of the heel portion. Therefore, the prior art midsole has a constant compressive hardness throughout the midsole and as a result, it cannot control effectively pronation and supination of the foot of an athlete although controlling them is required according to the kind of athletics.

Generally, by inserting a corrugated sheet, the heel portion of a midsole tends to be less deformed in the transverse direction. When the corrugated sheet is formed of high elastic material, the heel portion of a midsole tends to be less deformed in the vertical direction as well. Therefore, when the corrugated sheet has a constant wave configuration, the heel portion of a midsole where adequate cushioning is required may show less cushioning properties when contacting with the ground.

On the other hand, good cushioning properties are indispensable requirements of athletic shoes, but too high cushioning properties may absorb the athletic power such as the running or jumping power of an athlete.

The object of the present invention is to provide a midsole assembly for an athletic shoe that can prevent the over-pronation and over-supination on landing by preventing the shoe from being deformed in the transverse direction according to the kind of athletics, and not only ensures adequate cushioning properties but also prevents an athletic power from being lessened.

SUMMARY OF THE INVENTION

The present invention provides a midsole assembly for an athletic shoe.

In one embodiment, a midsole assembly comprises a midsole formed of soft elastic material and a corrugated sheet disposed in at least a heel portion of the midsole. The amplitude of the wave configuration of the corrugated sheet is larger at the medial and lateral portions of the heel portion and smaller at the heel central portion and transitions smoothly and progressively therebetween.

In a second embodiment, a midsole assembly comprises a midsole formed of soft elastic material and a corrugated sheet disposed in at least a heel portion of the midsole. The phase of the wave configuration of the corrugated sheet is offset by one-half pitch between the medial and lateral portions of the heel portion.

A third embodiment provides a midsole assembly according to the first or second embodiment, wherein hardness of the corrugated sheet is greater than that of the midsole.

A fourth embodiment provides a midsole assembly according to the first or second embodiment, wherein the corrugated sheet is comprised of fiber-reinforced plastics.

A fifth embodiment provides a midsole assembly according to the first or second embodiment, wherein a plurality of ribs are provided on the surface of the corrugated sheet.

In a sixth embodiment, a midsole assembly comprises a midsole formed of soft elastic material and a corrugated sheet disposed in at least a heel portion of the midsole. The corrugated sheet extends from the heel portion to the forefoot portion of the midsole. The wave-formed portion of the corrugated sheet is located at the heel portion and the forefoot portion.

A seventh embodiment provides a midsole assembly according to the sixth embodiment, wherein the wave-formed portion at the forefoot portion is disposed at the lateral and central portions of the forefoot portion.

An eighth embodiment provides a midsole assembly according to the seventh embodiment, wherein the amplitude of the wave configuration of the corrugated sheet at the forefoot portion is smaller at the central portion and larger at the lateral portion.

A ninth embodiment provides a midsole assembly according to the seventh embodiment, wherein the wavelength of the wave configuration of the corrugated sheet at the forefoot portion is smaller at the central portion and larger at the lateral portion.

A tenth embodiment provides a midsole assembly according to the sixth embodiment, wherein hardness of the corrugated sheet is greater than that of the midsole.

An eleventh embodiment provides a midsole assembly according to the sixth embodiment, wherein the corrugated sheet is comprised of fiber-reinforced plastics.

A twelfth embodiment provides a midsole assembly according to the sixth embodiment, wherein a plurality of concave or convex portions are provided on the surface of the plantar arch portion. The plantar arch portion connects the heel portion with the forefoot portion of the corrugated sheet.

In the first embodiment, a corrugated sheet is disposed in at least a heel portion of the midsole, and the amplitude of the wave configuration of the corrugated sheet is larger at the medial and lateral portions of the heel portion, and smaller at the heel central portion, and transitions smoothly and progressively therebetween.

Thus, flexibility of the midsole is maintained at the heel central portion and the greater compressive hardness of the midsole is ensured at the heel medial and lateral portions. As a result, cushioning properties on landing can be secured at the heel central portion, and transverse deformation after landing can be prevented at the heel medial and lateral portions, thereby improving the running stability.

In the second embodiment, a corrugated sheet is disposed in at least a heel portion of the midsole and the phase of the wave configuration of the corrugated sheet is offset by one-half pitch between the heel medial and lateral portions. That is, regarding the wave configuration, the crest at the medial portion is positioned against the trough at the lateral portion in the transverse, or shoe width direction, and similarly, the trough at the medial portion is positioned against the crest at the lateral portion in the transverse direction.

Thus, the ridge line of the wave configuration at the heel medial portion gradually declines as it goes toward the heel central portion, and when the ridge line crosses the heel central portion, the amplitude of the wave configuration becomes zero. As the ridge line goes over the heel central portion, it becomes a trough line, and the trough line declines as it goes toward the heel lateral portion.

Similarly, the ridge line of the wave configuration at the heel lateral portion gradually declines as it goes toward the heel central portion, and when the ridge line crosses the heel central portion, the amplitude of the wave configuration becomes zero. As the ridge line goes over the heel central portion, it becomes a trough line, and the trough line declines as it goes toward the heel medial portion.

In this way, because the amplitude of the wave configuration is zero at the central portion between the heel medial and lateral portions, similarly to the first embodiment, flexibility of the midsole is maintained at the heel central portion and the compressive hardness of the midsole is made greater at the medial and lateral portions of the heel portion. As a result, cushioning properties on landing can be secured at the heel central portion, and transverse deformation after landing can be prevented at the heel medial and lateral portions, thereby improving the running stability.

In the third embodiment, hardness of the corrugated sheet is greater than that of the midsole. Generally, when a shock load is repeatedly imparted to the midsole at the time of landing, the corrugated sheet deforms repeatedly with the midsole. As a result, the midsole gradually loses its elasticity and becomes worn. However, when the hardness of the corrugated sheet is set at a higher value, the midsole will be less worn due to the restitutory properties of the corrugated sheet, and thus, even after prolonged use of the midsole construction, the shock load on landing can be relieved and the cushioning properties can be secured.

In the fourth embodiment, the corrugated sheet is comprised of fiber-reinforced plastics. The fiber reinforced plastics (FRP) comprises reinforcement fiber and matrix resin. Reinforcement fiber may be carbon fiber, aramid fiber, glass fiber or the like. Matrix resin may be thermoplastic or thermosetting resin. In this way, the corrugated sheet has improved elasticity and durability, and can bear a prolonged use.

In the fifth embodiment, because a plurality of ribs are provided on the surface of the corrugated sheet, the elasticity of the corrugated sheet can be appropriately changed.

In the sixth embodiment, the corrugated sheet extends from the heel portion to the forefoot portion of the midsole, and the wave-formed portion of the corrugated sheet is located at the heel and forefoot portions.

In this case, at the time of landing, the heel portion to the forefoot portion of the midsole is less deformed transversely or laterally, and as a result, the lateral deformation of the forefoot portion as well as the heel portion can be prevented.

The wave-formed portion of the forefoot portion may be disposed at the lateral and central portions of the forefoot portion, as described in the seventh embodiment.

The amplitude of the wave configuration of the corrugated sheet at the forefoot portion may be smaller at the central portion and larger at the lateral portion, as described in the eighth embodiment.

In this case, because the compressive hardness of the midsole is greater on the lateral portion of the forefoot portion, the forefoot portion of a foot can be restrained from unnecessarily sinking toward the lateral side of the midsole after landing.

The wavelength of the wave configuration of the corrugated sheet at the forefoot portion may be smaller at the central portion and larger at the lateral portion, as described in the ninth embodiment.

In this case, when an athlete takes the next step inside after he or she lands on the ground from the lateral side of the forefoot portion, the load path (or the load carrying path) can nearly coincide with the direction of the director line or the direction perpendicular to each ridge line of the wave configuration. Thus, the lateral deformation of the forefoot portion can be securely prevented, and besides, flexibility toward the direction of the next step is improved. As a result, a smooth kick on the ground can be realized with secure gripping properties maintained.

Hardness of the corrugated sheet is preferably greater than that of the midsole, as described in the tenth embodiment. Thus, the midsole in which the corrugated sheet is interposed will be less worn.

The corrugated sheet may be comprised of fiber-reinforced plastics, as described in the eleventh embodiment. In this case, the elasticity and durability of the corrugated sheet is improved, and the corrugated sheet can be used even after a prolonged period.

A plurality of concave or convex portions may be provided on the surface of the plantar arch portion that connects the heel and forefoot portions of the corrugated sheet, as described in the twelfth embodiment. Thereby, the elasticity of the corrugated sheet can be appropriately changed.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale:

FIG. 2A is a top plan view of the midsole construction of a left side shoe; FIG. 2B is a lateral side view thereof; and FIG. 2C is a medial side view thereof;

FIG. 5A is a top plan view of the midsole construction of a left side shoe; FIG. 5B is a lateral side view thereof; and FIG. 5C is a medial side view thereof.

FIG. 9A is a to p plan view of the midsole construction of a left side shoe; FIG. 9B is a lateral side view thereof; and FIG. 9C is a medial side view thereof.

DETAILED DESCRIPTION OF THE PREFERRED EMBODIMENTS

Figure 1:
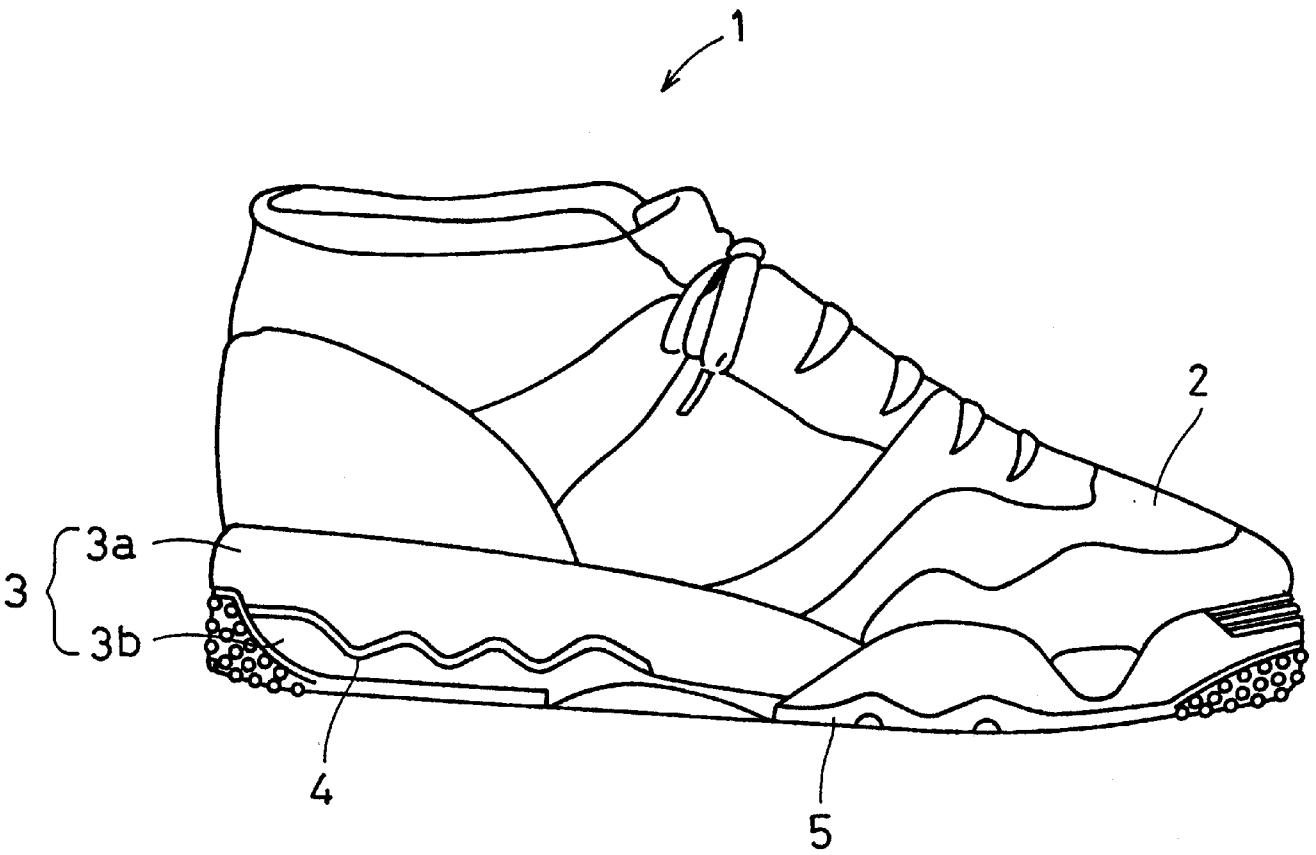
FIG. 1 is a side view of an athletic shoe incorporating the midsole construction of the present invention.

Turning now to the drawings, FIG. 1 illustrates an athletic shoe incorporating a midsole construction of the present invention. The sole of this athletic shoe 1 comprises a midsole 3, a corrugated sheet 4 and an outsole 5 directly contacting with the ground. The midsole 3 is fitted to the bottom of uppers 2. The corrugated sheet 4 is disposed in the midsole 3. The outsole 5 is fitted to the bottom of the midsole 3.

The midsole 3 is provided in order to absorb a shock load imparted on the heel portion of the shoe 1 when an athlete lands on the ground. The midsole 3 is comprised of an upper midsole 3*a* and a lower midsole 3*b* which are respectively disposed on the top and bottom surfaces of the corrugated sheet 4.

The midsole 3 is generally formed of soft elastic material having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber is used.

The corrugated sheet 4 is formed of thermoplastic resin such as thermoplastic polyurethane (TPU) of comparatively rich elasticity, polyamide elastomer (PAE), ABS resin or the like. Alternatively, the corrugated sheet 4 is formed of thermosetting resin such as epoxy resin, unsaturated polyester resin or the like.

As described above, in the midsole construction of the present invention, the corrugated sheet 4 is interposed between the upper midsole 3*a* and the lower midsole 3*b*, and bonded to the midsole 3*a* and 3*b*.

In this midsole construction, the pressure on landing, which is imparted from the upper midsole 3*a*, is dispersed by the corrugated sheet 4 and the pressured area of the lower midsole 3*b* becomes enlarged. As a result, compressive hardness throughout the midsole construction is made higher.

Referring to FIGS. 2–7, preferred embodiments of the midsole construction of the present invention are shown.

Figure 10:
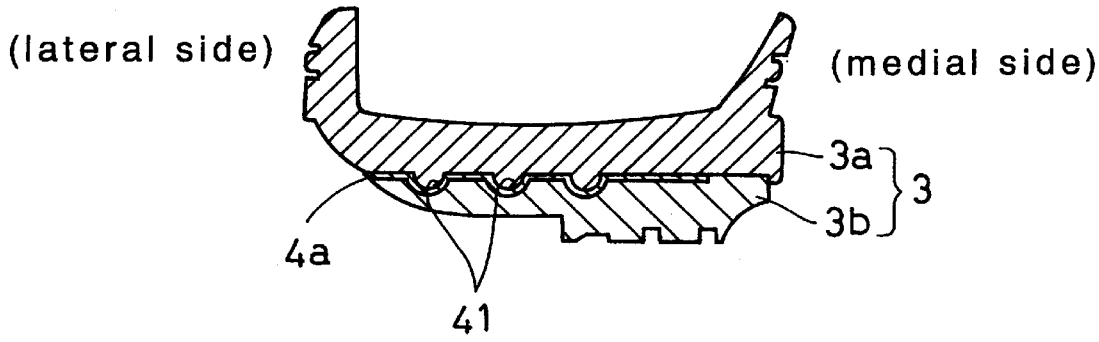
FIG. 10 is a cross sectional view of the midsole construction of FIG. 9 taken along line X—X.
Figure 11:
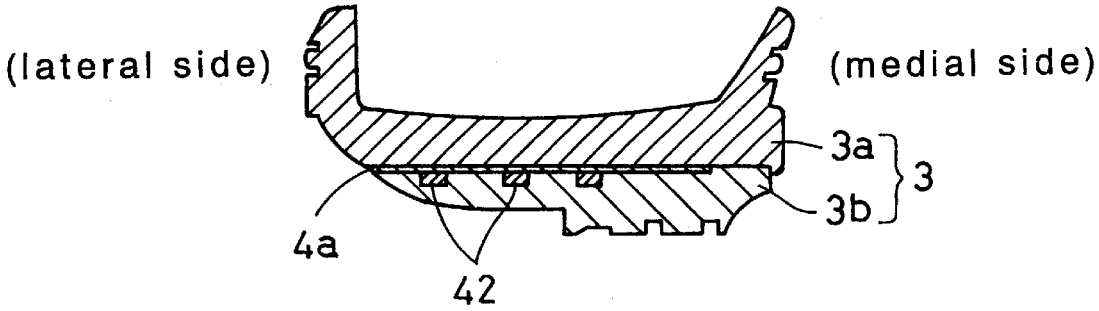
FIG. 11 is an alternative embodiment of FIG. 10.

FIG. 11 is an alternative embodiment of FIG. 10.

2 A>2 A' or A>A'

A: the amplitude at the heel medial and lateral portions of the wave configuration of the corrugated sheet 4;

A': the amplitude at the heel central portion of the wave configuration of the corrugated sheet 4.

In this case, flexibility of the midsole 3 is maintained at the heel central portion having a lower amplitude, and the compressive hardness of the midsole 3 is made greater at the heel medial and lateral portions having a larger amplitude. Thus, adequate cushioning properties on landing can be maintained at the heel central portion, and lateral deformation of the heel portion can be prevented at the heel medial and lateral portions, thereby improving the running stability.

In addition, the corresponding wave configurations between the heel medial and lateral portions of the corrugated sheet 4 do not need to coincide with each other. As long as the wavelength of one of the wave configurations coincides with the wavelength of the other wave configuration, the corresponding amplitudes may be different from each other. That is, when the amplitude of one of the wave configurations is A, the amplitude of the other wave configuration is not necessarily A.

Moreover, the ridge line L and the trough line L' of the wave configurations of the corrugated sheet 4 may be crossed at the heel central portion. In this case, the amplitude A' is approximately zero.

Figure 5B:
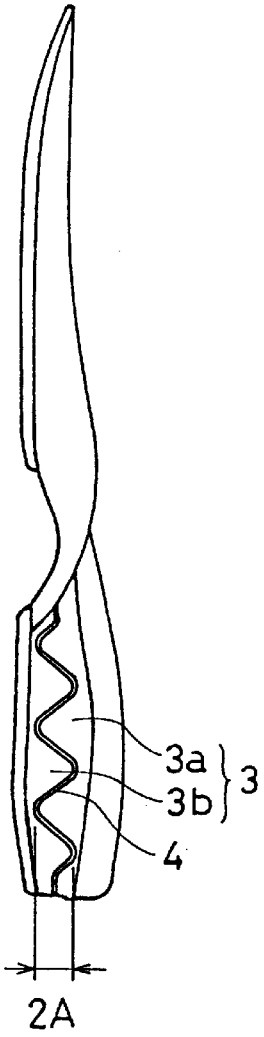
FIGS. 5A, 5B and 5C are schematic views illustrating the midsole construction of another embodiment of the present invention.
Figure 5A:
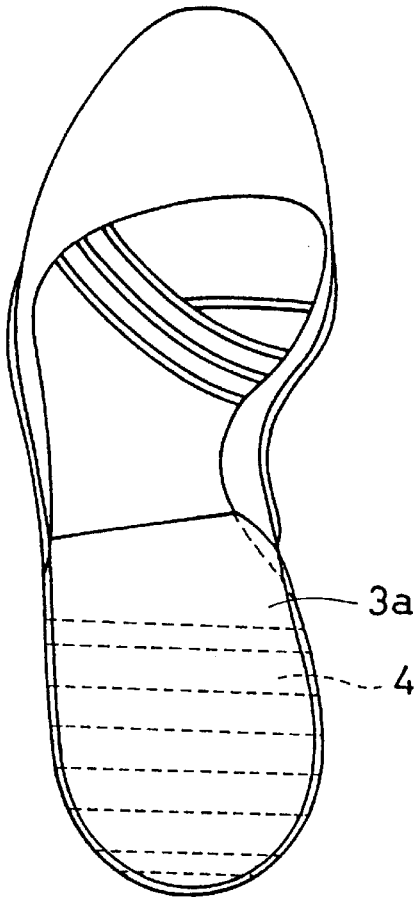
Figure 5C:
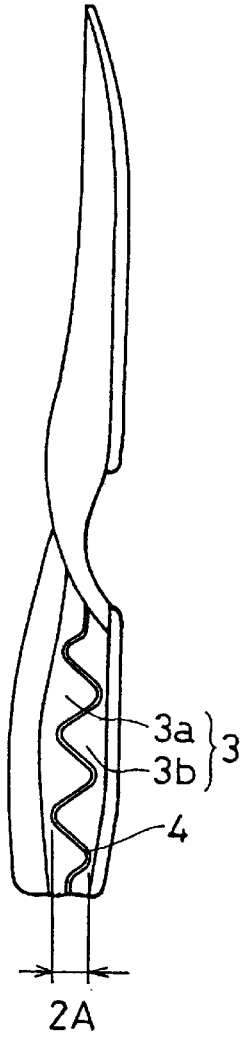
Figure 6:
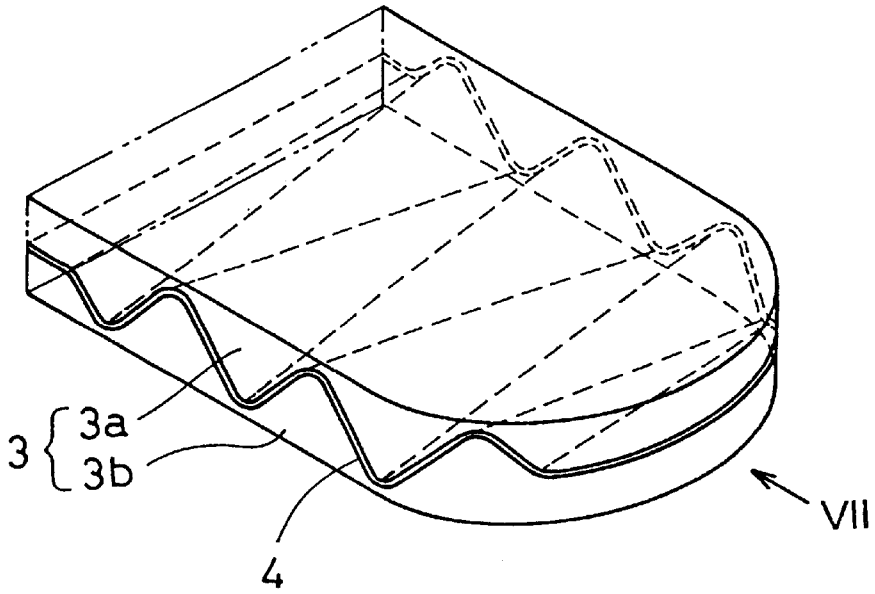
FIG. 6 is an enlarged perspective view of the heel portion of the midsole construction shown in FIGS. 5A, 5B and 5C.
Figure 7:
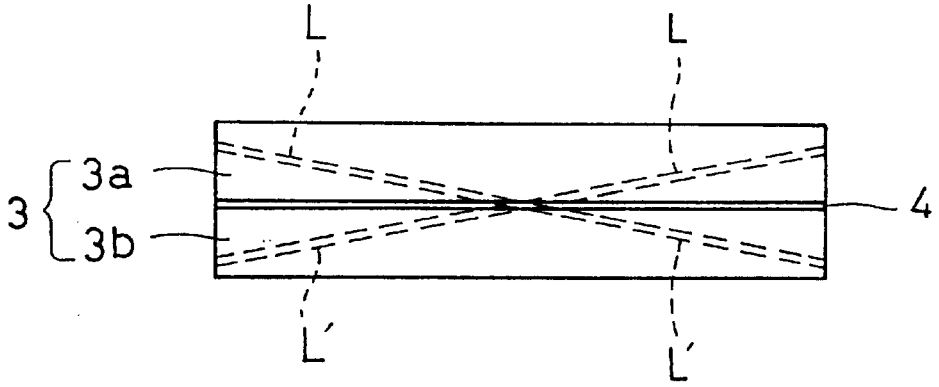
FIG. 7 is an end view of the heel portion shown in FIG. 6, as viewed in the direction VII shown in FIG. 6.

In the embodiment shown in FIGS. 5–7, the phase of the wave configuration of the corrugated sheet 4 is offset by one-half pitch between the heel medial and lateral portions.

That is, with regard to the wave configuration from the heel medial portion to the heel lateral portion, the ridge line L of the wave configuration at the heel medial portion gradually declines as it goes toward the heel lateral portion, and when the ridge line L crosses the heel central portion, the amplitude becomes zero. As the ridge line L goes over the heel central portion, it becomes a trough line L', and the trough line L' declines as it goes toward the heel lateral portion.

Similarly, the ridge line L of the wave configuration at the heel lateral portion gradually declines as it goes toward the heel central portion, and when the ridge line L crosses the heel central portion, the amplitude becomes zero. As the ridge line L goes over the heel central portion, it becomes a trough line L', and the trough line L' declines as it goes toward the heel medial portion.

In such a fashion, the amplitude of the wave configuration is zero at the heel central portion between the heel medial and lateral portions. Thus, similarly to the aforesaid embodiment, flexibility of the midsole is maintained at the heel central portion, and the compressive hardness of the midsole is made greater at the heel medial and lateral portions. As a result, cushioning properties on landing can be ensured at the heel central portion, and transverse deformation of the heel after landing can be prevented at the heel medial and lateral portions, thereby improving the running stability.

In another embodiment, the hardness of the corrugated sheet 4 is higher than that of the midsole 3. Generally, when shock load is repeatedly imparted to the midsole 3 on landing, the corrugated sheet 4 deforms repeatedly with the midsole 3. As a result, the midsole 3 gradually loses its elasticity and it becomes easy to be worn. On the contrary, when hardness of the corrugated sheet 4 is set at a higher value, the midsole 3 is hard to be worn due to the restitutory properties of the corrugated sheet 4. As a result, shock load on landing can be relieved even after a prolonged use and cushioning properties can be secured.

In yet another embodiment, the corrugated sheet 4 is formed of the fiber reinforced plastics (FRP). Thus, the corrugated sheet 4 will have improved elasticity and durability, and be able to bear a further prolonged use. The fiber reinforced plastics (FRP) is comprised of reinforcement fiber and matrix resin. Reinforcement fiber may be carbon fiber, aramid fiber, glass fiber or the like. Matrix resin may be thermoplastic or thermosetting resin.

Figure 8:
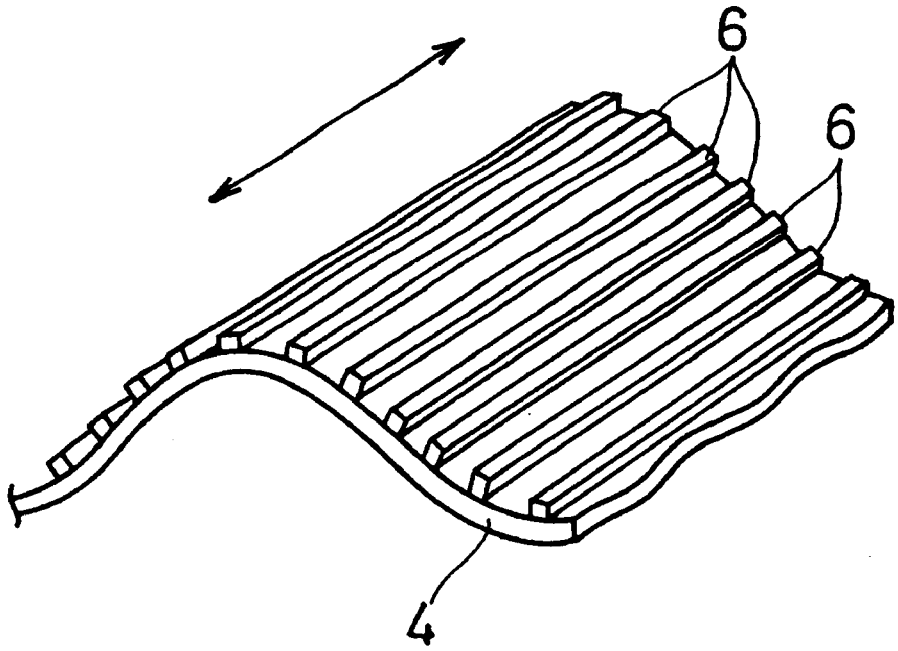
FIG. 8 is a perspective view of a portion of an alternative embodiment of the corrugated sheet.

In a further embodiment, as shown in FIG. 8, there are provided a plurality of ribs 6 along the ridge lines on the surface of the corrugated sheet 4. By adopting such a rib construction on the corrugated sheet 4, elasticity in the ridge direction can be selectively improved without excessively increasing elasticity in the direction perpendicular to the ridge line direction.

Referring to FIGS. 9–14, the midsole construction of still further embodiments of the present invention are shown.

Figure 14:
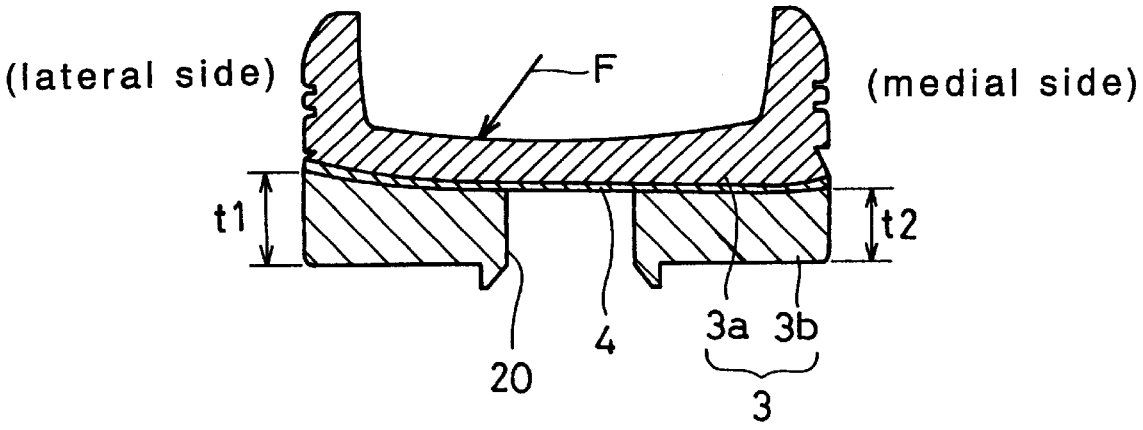
FIG. 14 is a cross sectional view of the midsole construction of FIG. 9 taken along line XIV–XIV.

In these embodiments, the wave-formed portion is provided at the forefoot portion as well as the heel portion of the midsole 3. The lower midsole 3*b* of the heel portion may have an opening 20 as shown in FIGS. 9A and 14.

By adopting such a construction, at the time of contact of a shoe with the ground, the portion from the heel to the forefoot of the midsole becomes less deformed transversely and thus, transverse or lateral deformation of the forefoot portion as well as the heel portion can be prevented.

On the other hand, the embodiments shown in FIGS. 2–7 are directed to preventing the transverse deformation of the heel portion. Thus, the midsole construction of these embodiments is most suitable for running where runners land more frequently at their heel portions, and it is not always suitable for athletics where athletes move more frequently in the transverse direction and often use their forefoot portion.

Consequently, in the embodiments shown in FIGS. 9–14, the wave-formed portion of the corrugated sheet 4 is provided at both the heel portion and the forefoot portion of the midsole 3 so that the transverse movement of the athletes can be supported at the heel portion as well as the forefoot portion.

Each of the wave-formed portions of the corrugated sheet 4 is connected at the plantar arch portion. Preferably, this connecting portion 4*a* includes a rib structure that is comprised of a plurality of concave portions or grooves 41 shown in FIG. 10. These grooves 41 extend along the connecting portion 4*a* and each of the grooves 41 is arcuately shaped in cross section. Such a rib structure can develop a so-called "shank effect" and thus, the rigidity of the plantar arch portion can be improved by such a simple structure and torsion of the plantar arch portion can be prevented.

Additionally, a convex portion having an arcuate shape in cross section may be substituted for the concave portion 41, or a combination of the convex and concave portions can be employed. Alternatively, as shown in FIG. 11, a rib 42 having a rectangular shape in cross section may be substituted for the concave portion 41.

Figure 9C:
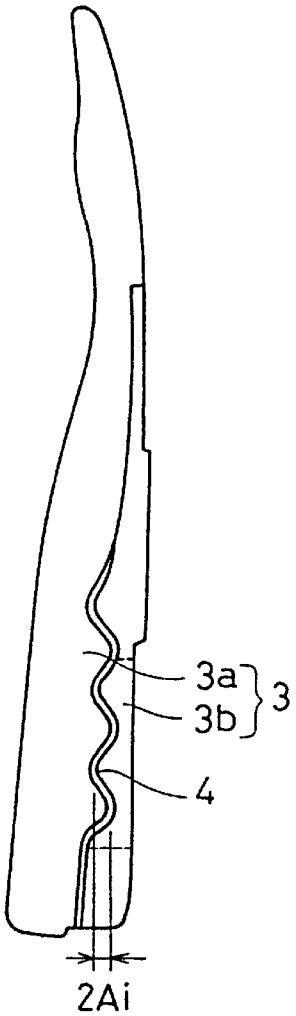
FIGS. 9A, 9B and 9C are schematic views illustrating the midsole construction of yet another embodiment of the present invention.
Figure 9A:
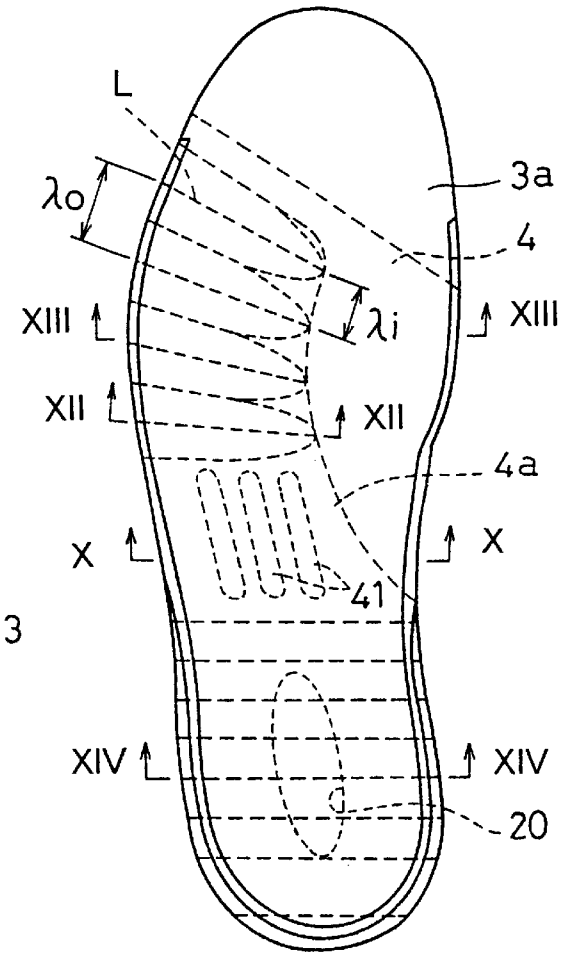
Figure 9B:
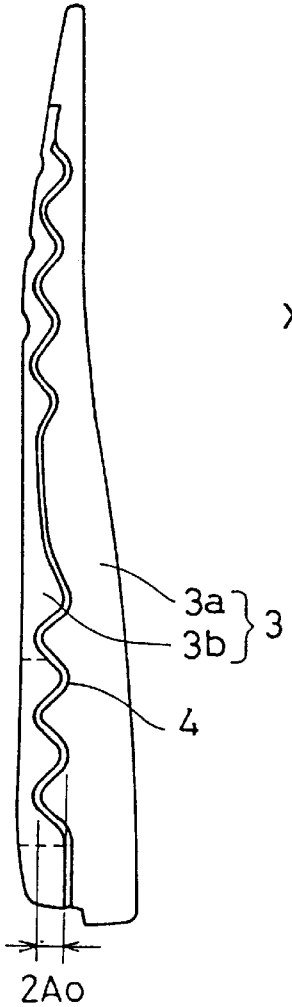

The wave-formed portion of the corrugated sheet 4 at the forefoot portion is placed at the lateral and central portions of the forefoot portion, as shown in FIG. 9. This is because the thickness of the midsole 3 at the forefoot portion is generally thin and in case of different amplitude between the medial and lateral portions, it is difficult to place the corrugated sheet 4 at the whole forefoot portion.

Regarding the amplitude of the corrugated sheet 4 at the forefoot portion, the amplitude of the lateral portion is preferably larger than that of the central portion. In this embodiment, the ridge line gradually declines as it goes toward the central portion from the lateral portion, and the amplitude of the central portion is zero.

Figure 12:
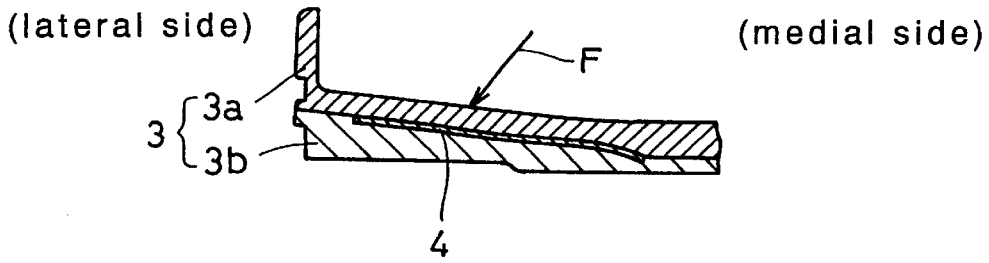
FIG. 12 is a cross sectional view of the midsole construction of FIG. 9 taken along line XII—XII
Figure 13:
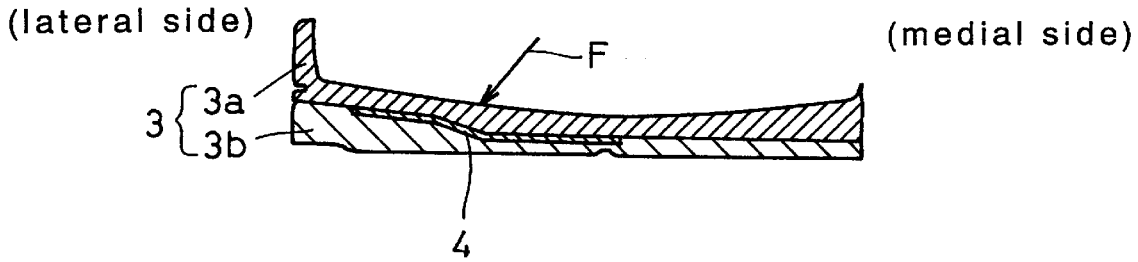
FIG. 13 is a cross sectional view of the midsole construction of FIG. 9 taken along line XIII—XIII.

In this way, by enlarging the amplitude of the lateral side of the forefoot portion, the compressive hardness of the midsole on the forefoot lateral side becomes greater. Thus, as shown in FIGS. 12 and 13, when the load F is applied on the forefoot lateral side of the midsole 3, the forefoot of an athlete is restrained from unnecessarily sinking toward the midsole lateral side. As a result, the lateral movement of the forefoot is supported and by utilizing a restitutory power of the elastically deformed midsole lateral portion, the athlete can come to move on the next step easily.

In addition, the following relation preferably exists between the wavelengths $\lambda i$ and $\lambda o$.

$\lambda i < \lambda o$ $\lambda i$: the wavelength at the forefoot central portion of the wave configuration of the corrugated sheet 4;

$\lambda o$: the wavelength at the forefoot lateral portion of the wave configuration of the corrugated sheet 4;

In this case, when athletes step the next step after they land on the ground on the forefoot lateral side, the applied load path or load path can nearly coincide with the director line of the wave configuration of the corrugated sheet 4. Thus, transverse deformation of the forefoot portion can be securely prevented and flexibility toward the direction of the step can be improved. As a result, secure gripping properties are maintained and a smooth kicking on the ground can be realized.

The direction of the ridge line L of the wave configuration of the corrugated sheet 4 at the forefoot portion is determined properly at such an angle that does not impede the flexibility of the forefoot portion.

Moreover, as shown in FIG. 9, the following relation preferably exists between the amplitudes Ai and Ao.

$Ai < Ao$

Ai: the amplitude at the heel medial portion of the wave configuration of the corrugated sheet 4;

Ao: the amplitude at the heel lateral portion of the wave configuration of the corrugated sheet 4;

Furthermore, as shown in FIG. 14, the following relation preferably exists between the thicknesses t1 and t2.

$t1 > t2$ t1: thickness of the lateral side of the lower midsole 3*b* at the cross section taken along line XIV—XIV;

t2: thickness of the medial side of the lower midsole 3*b* at the cross section taken along line XIV—XIV.

That is, the amplitude of the wave configuration at the lateral portion is larger than that of the wave configuration at the medial portion.

In this way, by enlarging the amplitude at the heel lateral side, compressive hardness of the midsole 3 at the heel lateral portion is made greater. Thus, when the load F is applied on the heel lateral side after landing (see FIG. 14), the heel portion of a foot of an athlete is restrained from unnecessarily sinking toward the midsole lateral side. As a result, the lateral movement of an athlete is effectively supported by the heel lateral side with the support of the forefoot portion, and besides, by utilizing the restitutory power of the elastically deformed midsole lateral side, the athlete come to be able to move on the next step with ease.

Conventionally, such a support at the midsole lateral portion was possible by making the height (or thickness) of the midsole lateral side higher (or thicker) than that of the midsole medial side and making the contact surface with an athlete's sole declined such that it is gradually declined from the lateral side to the medial side.

However, in this case, while an athlete is wearing such shoes, the lateral side of his or her foot is always lifted, which may cause injuries to his or her foot. Also, there is a problem that the midsole is easily worn when the repetitive load is applied. Therefore, such a prior art structure is not practically desirable.

On the contrary, according to the embodiment of the present invention, by causing the corrugated sheet 4 to develop its function only when the greater load is applied, load applied to the lateral side can be effectively supported without altering the thickness of the midsole.

In another embodiment, the corrugated sheet 4 has a higher hardness than the midsole 3. Thus, the midsole 3 can be less worn by utilizing the restitutory properties of the corrugated sheet 4. As a result, the cushioning properties can be maintained even after a prolonged use.

In yet another embodiment, the corrugated sheet 4 comprises fiber-reinforced plastic (FRP) that is strengthened by glass fibers or the like. Thus, elasticity and durability of the corrugated sheet 4 are improved, and the corrugated sheet 4 can endure a prolonged use.

In a further embodiment, a plurality of ribs extending along the ridge direction are provided on the surface of the corrugated sheet 4.

Thus, the elasticity of the ridge direction of the corrugated sheet 4 can be selectively improved without excessively increasing the elasticity in the direction perpendicular to the ridge direction.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet still fall within the scope of the invention.

What is claimed is:

1. A midsole assembly for an athletic shoe comprising:

a midsole that is formed of a soft elastic material, and that includes a midsole heel portion, which comprises an upper midsole part and a lower midsole part, and which is bounded by a midsole heel lateral side and a midsole heel medial side and has a midsole heel central portion between said lateral and medial sides; and a corrugated sheet that has a wave configuration including wave crests and wave troughs, and that is disposed in at least said midsole heel portion of said midsole between said upper midsole part and said lower midsole part;

wherein said wave configuration of said corrugated sheet has a varied amplitude of said wave crests and said wave troughs which includes a respective relatively larger amplitude at said lateral and medial sides and a relatively smaller amplitude at said central portion, and which amplitude varies smoothly and progressively between said relatively larger amplitude and said relatively smaller amplitude.

2. The midsole assembly according to claim 1, wherein said corrugated sheet extends continuously between said lateral and medial sides of said midsole heel portion.

3. The midsole assembly according to claim 1, wherein said varied amplitude is a positive amplitude everywhere in said midsole heel portion, said relatively smaller amplitude is a positive minimum amplitude, and said relatively larger amplitude is a positive maximum amplitude.

4. The midsole assembly according to claim 3, wherein said wave crests and said wave troughs respectively extend along ridge lines, each one of said ridge lines has an arcuate curved shape extending between said lateral and medial sides of said midsole heel portion, and said varied amplitude varies correspondingly along said arcuate curved shape of said ridge lines.

5. The midsole assembly according to claim 1, wherein said relatively smaller amplitude is a zero amplitude only exactly at a centerline midway between said lateral and medial sides of said midsole heel portion, said relatively larger amplitude is a maximum positive amplitude at said lateral and medial sides, and said amplitude varies smoothly and progressively between said zero amplitude and said maximum positive amplitude at locations between said centerline and said lateral and medial sides.

6. The midsole assembly according to claim 5, wherein said ridge lines of said wave crests on a first half of said heel portion between said centerline and said medial side transition straight into ridge lines of said wave troughs on a second half of said heel portion between said centerline and said lateral side, said ridge lines of said wave crests on said second half of said heel portion transition straight into ridge lines of said wave troughs on said first half of said heel portion, and said amplitude varies linearly between said zero amplitude at said centerline and said maximum positive amplitude at said lateral and medial sides.

7. The midsole assembly according to claim 1, wherein said midsole formed of said soft elastic material has a first hardness, and said corrugated sheet has a second hardness greater than said first hardness.

8. The midsole assembly according to claim 1, wherein said corrugated sheet comprises a fiber-reinforced plastic.

9. The midsole assembly according to claim 1, wherein said corrugated sheet further includes a plurality of ribs provided on and protruding from a surface of said wave configuration.

10. A midsole assembly for an athletic shoe comprising:

a midsole that is formed of a soft elastic material, and that includes a midsole heel portion, which comprises an upper midsole part and a lower midsole part, and which is bounded by a midsole heel lateral side and a midsole heel medial side; and a corrugated sheet that has a wave configuration including wave crests and wave troughs with a wave pitch defined by a cycle of a respective one of said wave crests and a respective one of said wave troughs, and that is disposed in at least said midsole heel portion of said midsole between said upper midsole part and said lower midsole part;

wherein said wave configuration has a first wave phase of said wave crests and said wave troughs at said medial side and a second wave phase of said wave crests and said wave troughs at said lateral side, wherein said first wave phase and said second wave phase are offset from each other by one half of said wave pitch.

11. The midsole assembly according to claim 10, wherein said midsole formed of said soft elastic material has a first hardness, and said corrugated sheet has a second hardness greater than said first hardness.

12. The midsole assembly according to claim 10, wherein said corrugated sheet comprises a fiber-reinforced plastic.

13. The midsole assembly according to claim 10, wherein said corrugated sheet further includes a plurality of ribs provided on and protruding from a surface of said wave configuration.

* * * * *

UNITED STATES PATENT AND TRADEMARK OFFICE

CERTIFICATE OF CORRECTION

PATENT NO. : 6,314,664 B1
DATED : November 13, 2001
INVENTOR(S) : Kita et al.

It is certified that error appears in the above-identified patent and that said Letters Patent is hereby corrected as shown below:

Title page,
Item [63], Related U.S. Application Data:
replace "now abandoned." by -- now U.S. Patent 6,219,939, issued: April 24, 2001. --.

Signed and Sealed this

Nineteenth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,314,664 B1
DATED : November 13, 2001
INVENTOR(S) : Kita et al.

It is certified that error appears in the above-identified patent and that said Letters Patent is hereby corrected as shown below:

Title page,
Item [30], under Foreign Application Priority Data: delete
"Apr. 18, 1997 (JP)…….9-116376".

Figure 2B:
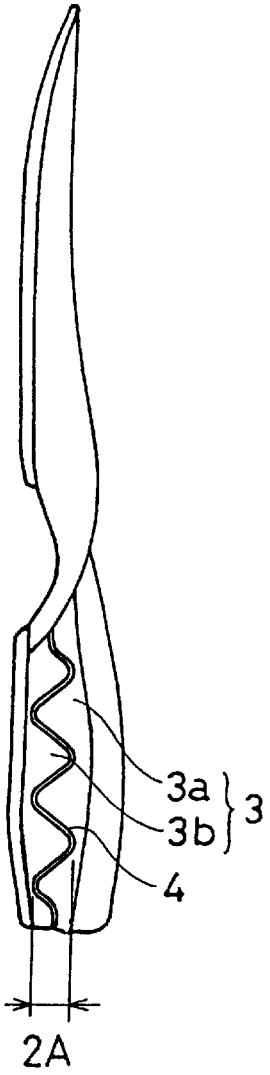
FIGS. 2A, 2B and 2C are schematic views illustrating the midsole construction of one embodiment of the present invention.
Figure 2A:
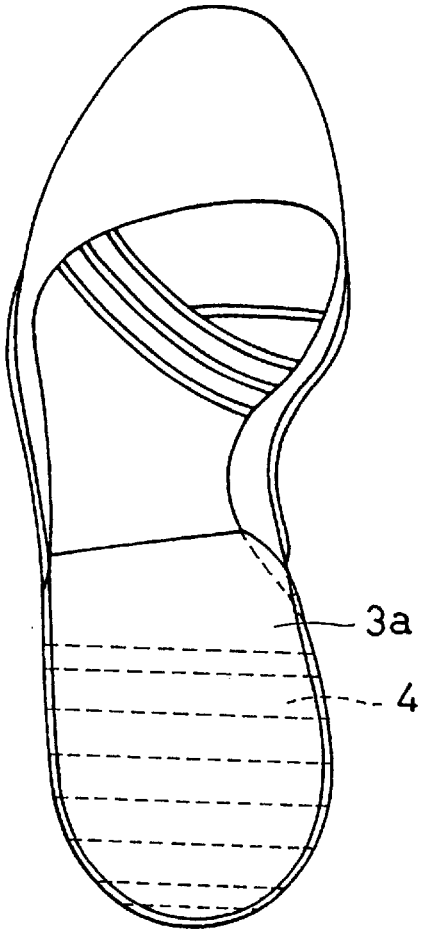
Figure 2C:
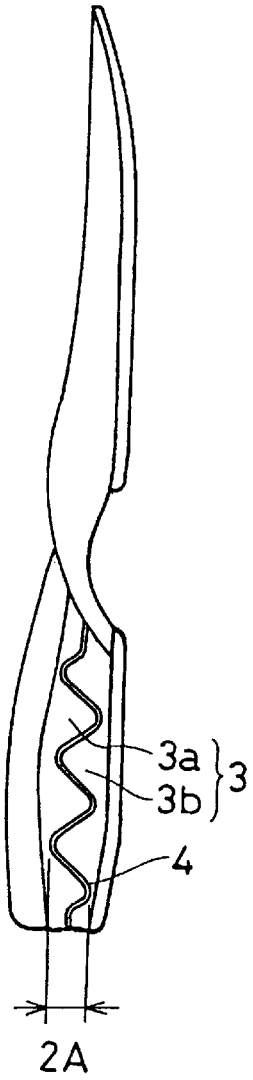
Figure 3:
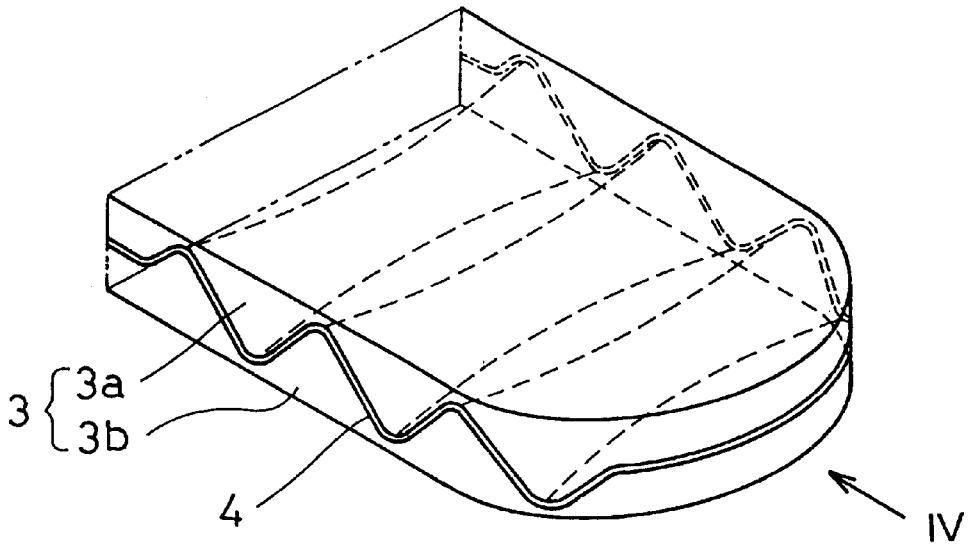
FIG. 3 is an enlarged perspective view of the heel portion of the midsole construction shown in FIGS. 2A, 2B and 2C.
Figure 4:
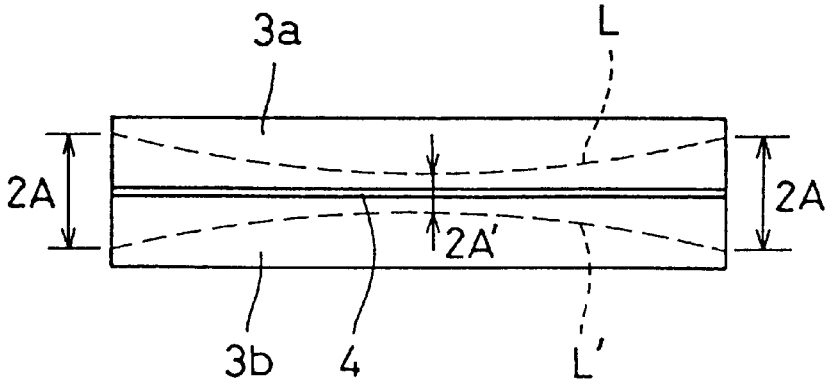
FIG. 4 is an end view of the heel portion shown in FIG. 3, as viewed in the direction IV shown in FIG. 3.

Column 6,
Line 17, replace "Fig. 11 is an alternative embodiment of Fig. 10." to read as follows:
-- In the embodiment shown in Figures 2 - 4, the amplitude of the wave configuration of the corrugated sheet 4 is larger at the medial and lateral portions of the heel portion, and smaller at the heel central portion, and transistions smoothly and progressively therebetween as shown in the Figures. That is, the following relation exists between the amplitudes A and A' --.

Signed and Sealed this

Sixth Day of August, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,314,664 B1
DATED : November 13, 2001
INVENTOR(S) : Kita et al.

It is certified that error appears in the above-identified patent and that said Letters Patent is hereby corrected as shown below:

Title page,
Item [30], Foreign Application Priority Data, delete
"Apr. 18, 1997 (JP).....9-116376".

Item [63], Related U.S. Application Data, replace "now abandoned." by -- now U.S. Patent 6,219,939, issued: April 24, 2001. --.

Column 6,
Line 17, replace "Fig. 11 is an alternative embodiment of Fig. 10." to read as follows:
-- In the embodiment shown in Figures 2 - 4, the amplitude of the wave configuration of the corrugated sheet 4 is larger at the medial and lateral portions of the heel portion, and smaller at the heel central portion, and transistions smoothly and progressively therebetween as shown in the Figures. That is, the following relation exists between the amplitudes A and A' --.

This certificate supersedes both Certificate of Correction issued March 19, 2002.

Signed and Sealed this

Fifth Day of November, 2002

*Attest:*

*Attesting Officer*

JAMES E. ROGAN
*Director of the United States Patent and Trademark Office*